US005924778A

United States Patent [19]

TenBrink

[11] Patent Number: 5,924,778

[45] Date of Patent: Jul. 20, 1999

[54] MODULAR DISPLAY CASE

[76] Inventor: Carl Evan TenBrink, 6851 Presidio Dr., Huntington Beach, Calif. 92648

[21] Appl. No.: 08/890,371

[22] Filed: Jul. 14, 1997

[51] Int. Cl.[6] ..... A47F 3/00

[52] U.S. Cl. ..... 312/114; 312/263; 312/350; 312/107

[58] Field of Search ..... 312/107, 108, 312/111, 114, 140, 263, 350

[56] References Cited

U.S. PATENT DOCUMENTS

| | | | |
|---|---|---|---|
| 3,219,400 | 11/1965 | Bergquist | 312/107 |
| 3,552,817 | 1/1971 | Marcolongo | 312/107 |
| 3,851,938 | 12/1974 | McCowan et al. | 312/111 X |
| 3,999,818 | 12/1976 | Schlanker | 312/107 X |
| 4,277,120 | 7/1981 | Drake et al. | 312/350 X |
| 5,046,789 | 9/1991 | Lee | 312/108 |
| 5,271,515 | 12/1993 | Berkheimer et al. | 312/107 X |
| 5,450,285 | 9/1995 | Schlemmer | 312/263 X |

*Primary Examiner*—Peter M. Cuomo
*Assistant Examiner*—Stephen Vu
*Attorney, Agent, or Firm*—Knobbe, Martens, Olson & Bear LLP

[57] ABSTRACT

A modular display case is disclosed. The display case comprises at least one frame member. The frame member is preferably "C"-shaped, having a front face selectively enclosed with a window. The frame member preferably includes grooves and bosses on an inside bottom surface for special use in displaying model train components. Frame members may be joined in end-to-end fashion with a tongue which slidably engages a first locking structure of each frame. In addition, each frame preferably has a second locking structure on a bottom surface and a corresponding locking structure on a top surface, whereby the frames may be arranged vertically in interlocking fashion.

9 Claims, 3 Drawing Sheets

MODULAR DISPLAY CASE

FIELD OF THE INVENTION

The present invention relates to a display case. More particularly, the present invention is a modular display case particularly adapted for displaying model trains.

BACKGROUND OF THE INVENTION

It is often desirable to store individual elements for display. A variety of structures are known for this purpose. For example, shelves may be mounted on support braces connected to a wall. Bookcase type structures, i.e. floor-supported structures having multiple shelves are also known. So that the items placed on the supporting structure are visible, these structures typically either have an open side or a glass front.

These displays have significant drawbacks. First and foremost, the displays are typically of a fixed size. The user may be forced to purchase a display which is much larger than necessary to store the desired elements. Further, if the user then obtains additional elements which exceed the number which may be held by the display, no mechanism is provided for enlarging the display short of obtaining another entire display.

Also, these displays are usually arranged for use in displaying a wide variety of items. The shelves are normally thus flat surfaced for allowing the user to place any number of items thereon.

One item which hobbyists wish to commonly store and display are model trains. Typical storage units are ineffective for use in displaying model trains. First, the train components are wheeled, and readily roll about the flat shelving of typical displays. As a result, the train elements may hit and damage one another or roll from the display onto the ground or the like.

In addition, the train components are usually all about the same size. Therefore, if one component is placed behind another, it is not visible.

Also, it is often desirable to display an entire "train" or assembled train components. This assembly is often longer than most displays are arranged to handle.

It is desirable to provide a display which overcomes the above-stated disadvantages.

SUMMARY OF THE INVENTION

In accordance with the present invention, there is provided a display case which is modular in nature, and which is especially adapted for displaying model train components. The display case may comprise a single element or multiple elements which are selectively connectable in either the horizontal or vertical direction.

Preferably, the display case comprises one or more interengageable frame segments or members. Each frame preferably is elongate and "C"-shaped in cross-section. The frame has an ordinarily open front face. The front face may be enclosed by sliding a window element into top and bottom slots formed in the frame.

The frame defines an inner compartment in which model train components may be located. The inner compartment is also sized to accept train components positioned in individual storage boxes.

The frame includes a pair of grooves on an inside surface of a bottom portion of the frame for accepting the wheels of the train components. Alternatively, model train track may be secured within the frame between two upstanding bosses. Then, model train components may be positioned on the track for display.

The frame members are preferably connectable in both a horizontal and vertical orientation. First, each frame member includes an interlocking structure for a tongue. The tongue may be partially inserted into an end of a first frame and into an end of a second frame, whereby the two frames are connected to one another in length-wise or horizontal alignment.

In addition, a top member of each frame includes a first locking structure and a bottom member of each frame includes a second locking structure. The first locking structure of one frame may be selectively engaged with the second locking structure of another frame. This allows two frames to be interlocked in vertical fashion.

Because the frames are both vertically and horizontally connectable, a modular display is created. The display may comprise a single frame or a number of frames connected in horizontal or vertical fashion.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
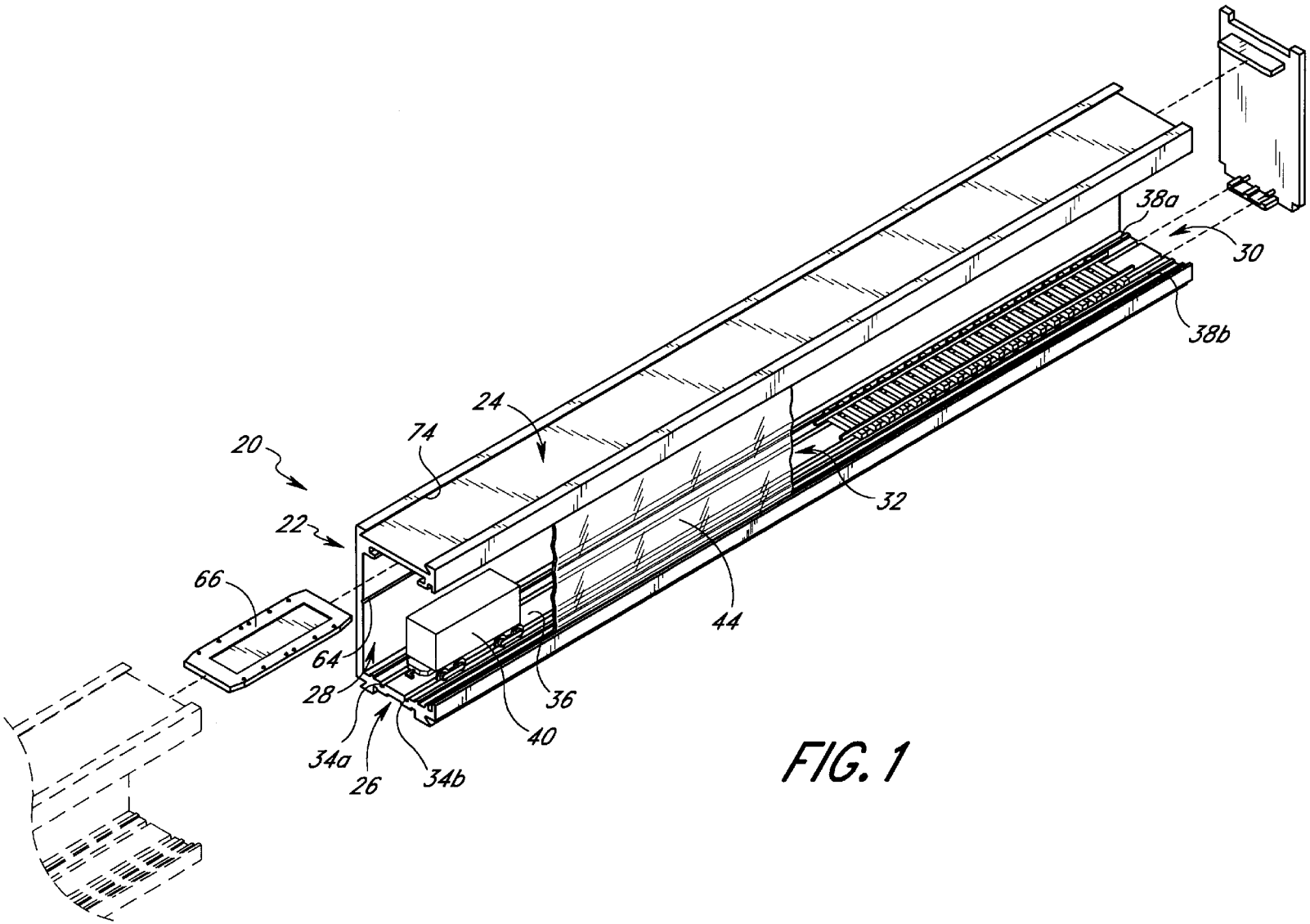
FIG. 1 is a perspective view of a first frame element in accordance with the present invention being connected to another frame element (illustrated in phantom) with a tongue element to form a display case in accordance with the present invention, and further illustrating an end cap for use with the frame element.
Figure 2:
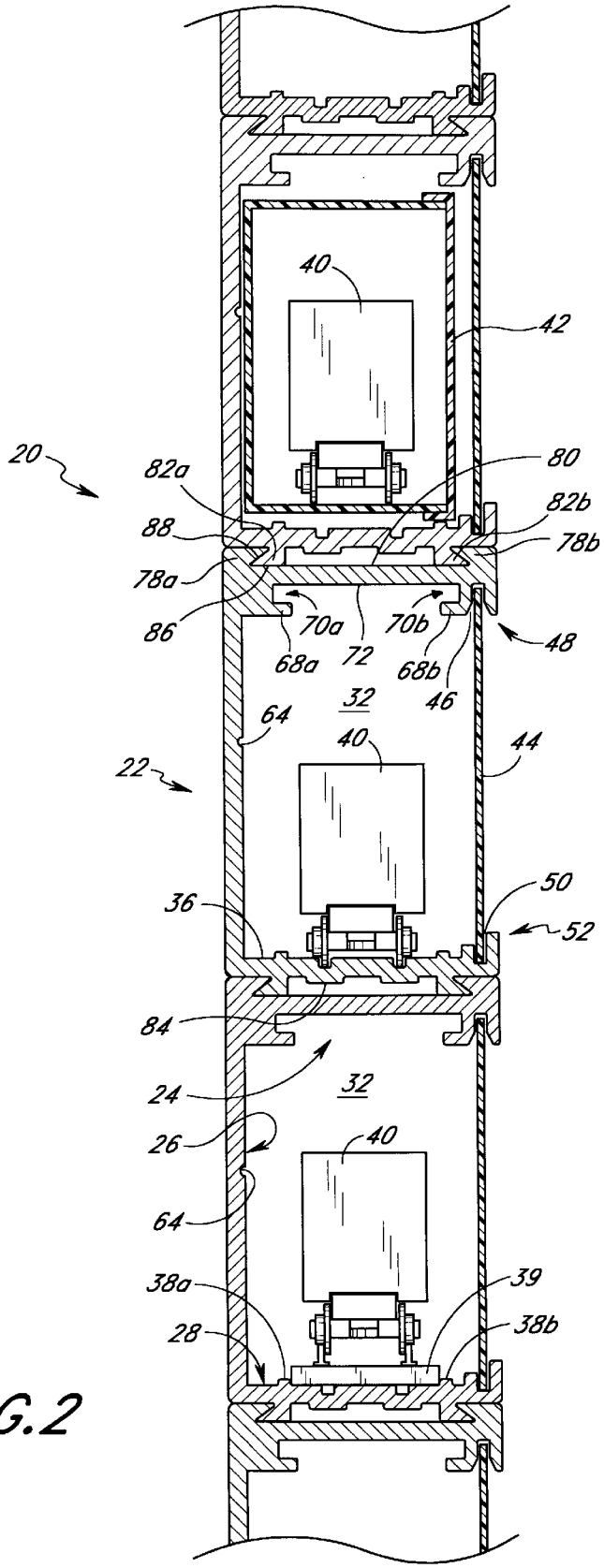
FIG. 2 illustrates several frame elements of the present invention stacked to form a vertically arranged display case in accordance with the present invention.

FIGS. 1 and 2 best illustrate a display case 20 in accordance with the present invention. In general, the display case 20 is adapted to hold one or more elements for viewing and storage, such as model trains. Advantageously, the display case 20 is of a modular construction, comprising one or more interlocking frames 22. Each frame 22 includes a number of features which are specially adapted to store and display model train components.

The present invention will now be described in more detail with reference to FIGS. 1–3. As illustrated therein, the display case 20 comprises one or more structural frames 22.

Each structural frame 22 is generally "C"-shaped. The frame 22 has a top member 24, a bottom member 26, and a connecting rear wall 28. The frame 22 has an open front face 30. The top and bottom members 24, 26 extend generally parallel to one another, with the rear wall 28 connecting the top and bottom members 24,26 and extending generally perpendicular thereto.

The frame 22 defines an interior space 32 which is adapted to hold an item for storage and display. In the preferred embodiment, the items to be stored and displayed are individual model train components, such as train cars, engines and the like. It is contemplated that the frame 22 be adapted for displaying other items such as model cars or the like.

As is well known, model trains come in a wide variety of sizes or scales. In the preferred embodiment, the frame 22 is sized to hold "N" scale or gauge model train components. To hold these train components, the top and bottom members 24,26 extend outwardly from the rear wall 28 about 1.125 inches. The distance between the top and bottom members 24,26 is preferably about 1.75 inches.

The frame 22 may have any of a variety of lengths. It is desired that the frame 22 be at least long enough to hold at least one train element. The frame 22 is preferably about 2 feet long, capable of storing several model train elements in series.

In the event it is desired to store and display train components of other scales or gauges, the dimensions of the frame 22 may be suitably larger or smaller. For example, in the event "Z" gauge model train elements are to be stored, the frame 22 may be made suitably smaller. In the event "HO" or "O" gauge model train elements are to be stored, the frame 22 may be made suitably larger.

The frame 22 element includes preferably a number of features which are specially adapted to facilitate the display of model train components.

First, a pair of grooves 34*a,b* may be formed in an inside surface 36 of the bottom member 26. The grooves 36*a,b* are each about 0.03 inches deep and 0.06 inches wide. The grooves 36*a,b* are spaced 0.3 inches apart. This spacing is the same as the distance between opposing sets of wheels on "N" scale model train components.

As best illustrated in FIG. 2, a model train component or element 40 may be positioned so that the inside flanges of its wheels extend into the grooves 34*a,b,* while the supporting portion of the wheel rests upon the inside surface 36 of the bottom member 26.

When so positioned, each train component 40 is locked into the grooves 34*a,b,* thus preventing the components from rolling about in the display 20.

A pair of bosses 38*a,b* preferably extend upwardly from the inside surface 36 of the bottom member 26. These bosses 38*a,b* are positioned outside of the grooves 34*a,b* as shown in FIGS. 1 and 2. The particular distance between the bosses 38*a,b* is slightly larger than the width of a standard "N" scale track section 39, or about 0.625 inches. The bosses 38*a,b* allow a user of the display 20 to position a track section 39 therebetween. When the track section 39 is between the bosses 38*a,b* it is prevented from sliding from side to side within the space 32.

As also illustrated in FIG. 2, when a track section 39 is positioned within the frame 22, one or more train components 40 may be positioned on the track for display.

As illustrated in FIG. 2, the frame 22 is so dimensioned to accept the train component 40 positioned within a jewel box or storage case 42. It is well known to those in the hobby to store model train elements in individual jewel cases 42. While these cases 42 are typically constructed of clear plastic and thus allow the viewing of the component 40 therein, it is often desired to store and display together a number of the components in their cases 42. In the present arrangement, the entire case 42 including the train component 40 may be positioned in the frame 22 for display and storage.

A transparent window 44 is selectively positionable over the otherwise open front face 30 of the frame 22 for enclosing this portion of the frame 22. When the train components 40 are not positioned within individual cases 42 but instead located on the grooves 34*a,b* or on track 39 positioned between the bosses 38*a,b,* the train elements might be jarred from the space 32 within the frame 22 through the otherwise open front face 30 and fall and be damaged. In addition, when the components 40 are stored for a long period of time, they may collect dust. The window 44 may be used to selectively enclose the face 30 and protect the items positioned within the frame 22.

As best illustrated in FIGS. 1 and 2, the frame 22 preferably includes means for selectively securing the window 44 thereto. This means may comprise a generally vertically extending slot 46 positioned within a flange part 48 along an outside edge of the top member 24, and a corresponding generally vertically extending slot 50 positioned in a flange part 52 extending along an outside edge of the bottom member 26. The two slots 46,50 are aligned with one another in the same plane.

The window 44 preferably comprises a thin sheet of plastic, plexiglass or similar durable and at least partially transparent material. The thickness of the window 44 and width of the slots 46,50 are selected so that the window 44 fits within the slots 46,50 and will slide therealong so as to be easily removed or installed through an end of the frame 22.

The frame 22 may be supported on a surface by resting the bottom member 26 on the surface. On the other hand, it often desirable to mount the case to a wall or other vertical support structure. Preferably, a groove 64 is formed in the rear wall 28 generally midway between the top and bottom members 24,26. The groove 64 extends from the interior area 32 slightly into the material comprising the rear wall 32.

The groove 64 advantageously serves as a guide for a drill bit or the like for forming a hole in the rear wall 28 of the frame 22. The reduced thickness of the rear wall 28 in the area of the groove 64 also makes it easier to penetrate the wall 28 with a fastener (and yet allows the remainder of the wall 28 to maintain a thickness which provides rigidity and support to the frame 22).

To mount the frame 22 to a wall or similar support structure, a through-hole is formed through the wall 28 at a desired location along the groove 64. Next, a suitable fastener, such as a screw or nail, is extended through the rear wall 28 and into engagement with the vertical support for mounting the frame 22.

In accordance with the present invention, each frame 22 may be used alone (in which case the display case 20 comprises a single frame 22), or in conjunction with one or more additional frames 22 for creating a large display case 20. The ability of the frames 22 to be selectively engaged permits the display case 20 to have a modular construction.

First, the frames 22 are adapted to be joined in horizontal or "length-wise" alignment, as illustrated in FIG. 1. Here, individual frames 22 are joined to create a display comprising multiple frames 22. This display case 20 has a length which is larger than the length of a single frame 22.

Means are provided for selectively joining the frames 22. Preferably, this means comprises a tongue 66 for engagement with a support structure on a frame 22.

The tongue 66 is a generally rectangular-shaped element which is adapted to engage two frames 22. As illustrated in FIGS. 1 and 2, each frame 22 has a pair of tabs 68*a,b*. One tab 68*a* preferably extends inwardly from the rear wall 28 just below the top member 24, and the other tab 68*b* preferably extends inwardly from the flange part 48 just below the top member 24. These tabs 68*a,b* define a pair of grooves 70*a,b* which extend along an inside surface 72 (see FIG. 2) of the frame 22.

The tongue 66 is adapted to extend along the inside surface 72 of the top member 24 of the frame 22, and have its outer edges within the grooves 70*a,b*. In this position, the tongue 66 is supported along its parallel outer edges by the tabs 68*a,b*.

Each tongue 66 is preferably about 3 inches long, and has a width just slightly less than the distance between the closed ends of the grooves 70*a,b*. In use, a user extends one end of a tongue 66 into one of the frames 22 in a manner described above. The user extends the tongue 66 into engagement with a frame 22 until about half of the length of the tongue 66 is extending from the end of the frame 22. Then, the user slides an end of a mating frame 22 over the other half of the tongue 66 until the frames 22 abut and are joined to form a single contiguous display case 20.

In order that the tongue 66 frictionally engage the frames 22, the tongue 66 may be provided with a number of small beads which extend outwardly from the outer surface of the tongue along the side edges thereof. These beads or other members are preferably arranged to somewhat lock the tongue 66 to the frame 22, but in a manner which still allows the user to install and remove them by hand.

As stated above, the frames 22 are also adapted to be vertically arranged. In particular, each frame 22 includes means for selectively securing one frame to the top or bottom of a mating frame, as illustrated in FIG. 2. This means preferably comprises a first locking member positioned on one frame for selective engagement with a second locking member positioned on another frame.

Figure 3:
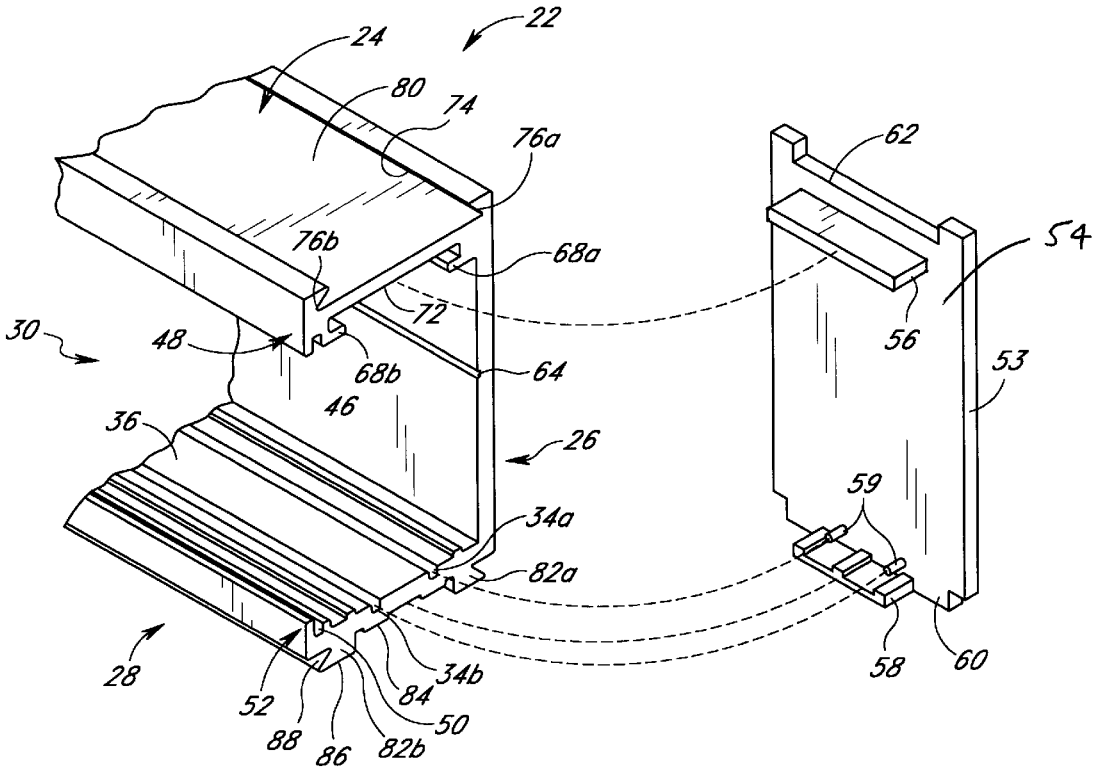
FIG. 3 is an enlarged view of an end of the frame element and end cap illustrated in FIG. 1.

As best illustrated in FIGS. 2 and 3, one locking member preferably comprises a groove 74 extending along the outside surface 80 of the top member 24 and defined by a pair of lips 78*a,b*. A first lip 78*a* extends upwardly and inwardly from the junction of the rear wall 28 and top member 24. A second lip 78*b* extends upwardly and inwardly from the flange part 48. As illustrated, each lip 78*a,b* has an inner surface which angles upwardly from the outside surface 80 of the top member 24, and inwardly towards the center of the top member 24.

The second or mating locking member preferably comprises a pair of feet 82*a,b* extending downwardly from the outside surface 84 of the bottom member 26. Each foot 82*a,b* first extends downwardly from the bottom member 26, and then extends outwardly. Each foot 82*a,b* has a generally flat bottom surface 86 and an angled surface 88.

The bottom surface 86 of each foot 82*a,b* is adapted to rest upon the flat outside surface 80 of a top member 24 of a mating frame 22. In addition, the angled surface 88 of each foot 82*a,b* is adapted to engage the angled surface of a respective lip 76*a,b* of the mating frame 22.

FIG. 2 illustrates the relationship of two vertically arranged frames 22. In use, a user slides the feet 86*a,b* of one frame 22 into the groove 74 of a mating frame 22. Preferably, the user aligns an end of one frame 22 with an end of another frame 22 with the feet 86*a,b* and groove 74 aligned, and then moves the frames 22 relative to one another.

A frame 22 may be connected to the top or bottom of any other frame 22 in that instance where each frame 22 carries both the feet 86*a,b* and the groove 74. Of course, it is possible to have the frame 22 include only either the feet 86*a,b* or groove 74. In that instance, only one other frame 22 may be connected to that particular frame.

It is possible to connect a number of frames 22 in both the vertical and horizontal manners described above. So connected, a display case 20 is created which is both long and which has a number of different vertical levels. This allows a user to customize the display case 20 to the particular desired size and shape.

It is also desired that each frame 22 be enclosable at its ends, to prevent the train components 40 from sliding or rolling out the ends of the frame 22, and to protect the components from dust and the like.

As best illustrated in FIG. 3, an end cap 54 is provided for selectively enclosing the ends of the frame 22. Each end of the frame 22 is preferably cut square, that is, lies in a plane which is perpendicular to the members 24,26 and rear wall 28. The caps 54 are generally planar and sized to enclose the end of the frame 22.

Each end cap 54 preferably includes means for removably connecting it to the frame 22. Preferably, this means comprises a top tab 56, a bottom tab 58, and a pair of pins 59. The top tab 56 extends from a face of the cap 54 and has a width to fit, like the tongue 66, within the grooves 70*a,b*. The bottom tab 58 is adapted to engage the bottom side 84 of the bottom member 28 between the legs 82*a,b*. As illustrated, the bottom side 84 has a pair of downwardly extending sections corresponding to the grooves 34*a,b* and recessed areas therebetween. The bottom tab 58 preferably mates with the bottom member 28. In addition, the pins 59 are sized and positioned to slide into the grooves 34*a,b* in the bottom member 28.

Preferably, each end cap 54 has an extended portion 60 at its bottom end and a recessed portion 62 at its top end. When two frames 22 are arranged vertically, as described above, the extended portion 60 of an end cap 54 of the top frame 22 extends into the recessed portion 62 of the end cap 54 of the frame 22 therebelow. In this manner, the end caps 54 interlock to form a contiguous end surface. The end caps 54 may be made of plastic or another suitable material.

The frame 22 may be formed of a variety of materials. Preferably, the frame 22 is formed of aluminum. This allows the frame 22 to be rigid and sturdy, and yet lightweight. The frame 22 may be made of other metals, plastic, wood or other materials as known to those skilled in the art.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A display case comprising at least one frame, said frame being generally "C"-shaped and having a generally upright wall with a top member and a bottom member extending therefrom generally perpendicular to said wall, said wall and top and bottom members defining a display area having an open front, said frame having a pair of grooves in an inside surface of said bottom member, each of said grooves adapted to accept a portion of an item to be displayed, a pair of upstanding bosses extending upwardly from said inside surface, a slot in said top member positioned generally opposite said wall and a slot in said bottom member positioned generally opposite said wall, said slots adapted to receive a window member for enclosing said open front, said top member having a first locking member and said bottom member having a second locking member, said locking members adapted for selective engagement with a mating locking member on another frame, permitting frames to be vertically stacked, a groove in said rear wall for use in mounting said frame, and said top member including a locking structure for use in connecting a first end of said frame to an end of another frame, said frame having an end cap engaging an end of said frame, wherein said end cap has a first tab engaging said top member, a pair of pins extending into said grooves, and a second tab engaging said bottom member.

2. The display case in accordance with claim 1, wherein said first locking member on said top member comprises a groove extending along a top surface of said top member between two lips.

3. The display case in accordance with claim 2, wherein said mating locking structure on said bottom member comprises a pair of spaced feet for engaging said lips.

4. The display case in accordance with claim 3, wherein each of said lips has an inwardly slanting surface and each foot has a flat bottom surface for engaging said top surface of said top member and a slanted surface for positioning under said surface of said lip.

5. The display case in accordance with claim 1, further including a window positioned within said slots.

6. The display case in accordance with claim 1, further including a tongue engaging said locking structure.

7. A display case comprising at least one frame, said frame being generally "C"-shaped and having a generally upright wall with a top member and a bottom member extending therefrom generally perpendicular to said wall, said wall and top and bottom members defining a display area having an open front, said frame having a pair of grooves in an inside surface of said bottom member, each of said grooves adapted to accept a portion of an item to be displayed, a pair of upstanding bosses extending upwardly from said inside surface, a slot in said top member positioned generally opposite said wall and a slot in said bottom member positioned generally opposite said wall, said slots adapted to receive a window member for enclosing said open front, said top member having a first locking member and said bottom member having a second locking member, said locking members adapted for selective engagement with a mating locking member on another frame, permitting frames to be vertically stacked, a groove in said rear wall for use in mounting said frame, and said top member including a locking structure for use in connecting a first end of said frame to an end of another frame, wherein said locking structure comprises a first groove near said rear wall positioned between said top member and a first lip and a second groove positioned generally opposite said rear wall between said top member and a second lip.

8. The display case in accordance with claim 7, wherein said pair of grooves are spaced to receive opposing wheels of a train element displayed in said display.

9. The display case in accordance with claim 7, wherein said bosses are spaced by a distance sufficient to accept a segment of model train rail therebetween.

* * * * *